US005755930A

United States Patent [19]

Satterfield et al.

[11] Patent Number: 5,755,930

[45] Date of Patent: May 26, 1998

[54] PRODUCTION OF FILLED PAPER AND COMPOSITIONS FOR USE IN THIS

[75] Inventors: Brian Frederic Satterfield, Columbia, S.C.; Bruce Evans, Bethlehem, Pa.; Thomas Adrian Cauley, Burlington, Canada

[73] Assignees: Allied Colloids Limited, West Yorkshire, United Kingdom; Minerals Technologies Inc., Bethlehem, Pa.

[21] Appl. No.: 600,579

[22] Filed: Feb. 13, 1996

Related U.S. Application Data

[63] Continuation-in-part of Ser. No. 191,930, Feb. 4, 1994.

[51] Int. Cl.[6] ..... D21H 23/14

[52] U.S. Cl. ..... 162/164.1; 162/164.3; 162/164.5; 162/165; 162/168.2; 162/168.3; 162/175; 162/181.1; 162/181.2; 162/183

[58] Field of Search ..... 162/164.1, 164.3, 162/164.5, 168.1, 165, 168.2, 168.3, 169, 175, 183, 181.1, 181.2

[56] References Cited

U.S. PATENT DOCUMENTS

| | | | |
|---|---|---|---|
| 4,070,236 | 1/1978 | Carrard et al. | 162/164 |
| 4,680,212 | 7/1987 | Blyth et al. | 428/97 |
| 4,874,466 | 10/1989 | Savino | 162/164.3 |
| 4,913,775 | 4/1990 | Langley et al. | 162/183 |
| 5,026,457 | 6/1991 | Eichinger et al. | 162/158 |
| 5,126,010 | 6/1992 | Kobayashi et al. | 162/135 |
| 5,147,507 | 9/1992 | Gill | 162/158 |
| 5,216,014 | 6/1993 | Chung | 162/168.2 |
| 5,244,542 | 9/1993 | Bown et al. | 162/183 |
| 5,516,405 | 5/1996 | De Witt | 162/164.1 |

FOREIGN PATENT DOCUMENTS

| | | | |
|---|---|---|---|
| 0 017 353 | 10/1980 | European Pat. Off. | D21D 3/00 |
| 0281134 | 9/1988 | European Pat. Off. . | |
| 0382427 | 8/1990 | European Pat. Off. . | |
| 0608986 | 8/1994 | European Pat. Off. . | |
| 2251254 | 1/1992 | United Kingdom . | |
| 9521296 | 10/1995 | WIPO . | |

OTHER PUBLICATIONS

Tappi, 1990 Neutral/Alkaline Paper Making, pp. 92–97.

*Primary Examiner*—Peter Chin

*Attorney, Agent, or Firm*—Sughrue, Mion, Zinn, Macpeak & Seas, PLLC

[57] ABSTRACT

Filled paper is made by adding a cationising amount of cationic polymer to precipitated calcium carbonate or other filler either as a slurry or in a thick stock component, producing a thin stock containing the cationised filler and then treating the thin stock with a formaldehyde resin and polyethylene oxide as a retention system prior to drainage and drying.

24 Claims, No Drawings

PRODUCTION OF FILLED PAPER AND COMPOSITIONS FOR USE IN THIS

RELATED APPLICATION

This application is a continuation-in-part of U.S. Ser. No. 08/191,930 filed 4th Feb. 1994 by Brian Frederic Satterfield and John Oliver Stockwell.

FIELD OF THE INVENTION

This invention relates broadly to the manufacture of filled paper and to filler compositions for use in this.

BACKGROUND OF THE INVENTION

It is standard practice to make filled paper by mixing filler with a cellulosic suspension and forming a thin stock, mixing a polymeric retention aid into the thin stock, draining the thin stock on a screen to form a sheet and drying the sheet.

The quality of the resultant paper depends in part on the nature of the initial cellulosic suspension and the amount and nature of filler and other additives. Fine papers may be highly filled and sized and formed from a relatively pure suspension. Other paper, such as newsprint, is made from cellulosic suspension which is frequently referred to as being "dirty" or as containing "anionic trash". Typical of such suspensions are those which contain a significant proportion of groundwood or other mechanically derived pulp, or de-inked pulp or broke.

Originally paper such as newsprint was generally substantially unfilled while fine paper was filled, but there is now a demand for papers such as newsprint to include some filler.

The purpose of the polymeric retention aid is to promote the retention of paper fines, and filler if present. A single polymer, or a combination of materials may be used, and the nature of the retention system has to be selected according to the nature of the suspension in order to obtain optimum results. It is desirable to achieve the maximum possible retention of filler and of fibre fines, irrespective of the nature of the filler.

It is known to promote retention of fibre fines from a dirty suspension by using, as the retention system, a solution of phenol formaldehyde resin followed by polyethylene oxide. The use of combinations of synthetic tanning agent and polyethylene oxide are described in U.S. Pat. No. 4,070,236. The use of a particular type of formaldehyde resin and polyethylene oxide is described in U.S. Ser. No. 08/191,930 and PCT/GB95/00232.

There are some proposals in the literature suggesting particular ways of improving retention of some fillers by treatment with, for instance, a relatively low molecular weight cationic polymer prior to the addition of polymeric retention aid into the thin stock.

For instance in EP-A-608,986 it is proposed to coagulate filler in a thick stock feed suspension by adding cationic coagulant to the feed suspension and forming thin stock from this, adding bentonite to the thin stock or to the thick stock before it is converted to the thin stock, subsequently adding polymeric retention aid to the thin stock and forming paper from the thin stock. The process is intended mainly for dirty suspensions. Fillers which are mentioned are china clay, calcium carbonate and kaolin. However all the experimental data relates to the use of calcined clay and shows that treatment of the calcined clay with cationic coagulant before addition to the thick stock is much less effective than adding the coagulant to a preformed mixture of the cellulosic suspension and clay. In fact, the data shows that retention of the clay is not improved by pretreatment of the clay with the cationic coagulant.

U.S Pat. Nos. 4,874,466, 5,126,010, 5,126,014 and GB 2,251,254 are other disclosures of processes in which cationic coagulant is added with the intention of improving retention of filler.

A particular problem can arise when the filler is precipitated calcium carbonate (PCC), partly because retention properties are liable to vary somewhat unpredictably especially when using dirty cellulosic suspensions.

PCC is generally made at the paper mill by injecting carbon dioxide into an aqueous lime solution to form a slurry typically having a PCC content typically of 13–20%.

It has already been proposed that it can be desirable to provide a cationic surface charge to aid retention of PCC and other fillers, see for instance the abstract of Tappi 1990 Neutral/Alkaline Papermaking, Tappi Short Course Notes, pages 92 to 97 by Gill, in which the author states that the zeta potential of a filler is important to retention. Other disclosures about the retention of filler are in the references listed in that paper.

In U.S. Pat. No. 5,147,507 Gill is concerned with the manufacture of sized paper from a clean pulp. He describes treating PCC with a ketene dimer size which has been made cationic by treating the dimer with a polyamino-amide or a polyamine polymer reacted with an epoxinised halohydrin compound. The use of 0.25 to 2% of this cationic polymeric size material is said to produce a filler having a reduced sizing demand. It is also shown to achieve a small improvement in the filler retention. For instance it is shown in one fine paper example that filler retention can be increased from 72% to 77.4% by the described treatment of PCC.

PCC retention in the dirty pulps with which we are concerned is always very much less, and is frequently in the range 0% to 15%. The resultant paper is usually unsized. Pretreatment with a cationic polymer can increase retention but the value is still unacceptably low.

OBJECT OF THE INVENTION

One object of the invention is to provide a paper-making process which utilises filler and which can give significantly improved retention of filler.

Another object is to achieve this when the cellulosic suspension is a groundwood or other "dirty" suspension.

Another object of the invention is to achieve this when the paper is a material such as newsprint, supercalendered, mechanically finished, mechanically finished coated or lightweight coated paper, wherein the paper is typically unsized.

Another object of the invention is to achieve this when the filler is PCC.

Another object is to make paper which is filled with PCC and which has improved properties, for instance as regards formation and linting.

SUMMARY OF THE INVENTION

According to one aspect of the invention we make filled paper by a process comprising forming a filled thin stock from filler, water and one or more cellulosic thick stock components by a method which includes blending the filler with a cationising amount of cationic polymer while the filler is present in a thick stock component or as a slurry having a filler content of at least 5%.

mixing a water soluble anionic formaldehyde resin and polyethylene oxide into the thin stock, and then draining the thin stock through a screen to form a sheet and drying the sheet.

According to another aspect of the invention we make filled paper by a process comprising mixing a slurry of precipitated calcium carbonate with a cationising amount of a cationic polymer, forming a thin stock by a process comprising mixing the cationised slurry of PCC with a cellulosic suspension, then mixing a water soluble formaldehyde resin into the filled thin stock, and then mixing polyethylene oxide into the thin stock and then draining the thin stock through a screen to form a sheet and drying the sheet.

DESCRIPTION OF PREFERRED EMBODIMENTS

A preferred method of the invention comprises blending a slurry of the filler with the cationising amount of cationic polymer and then forming the thin stock containing the cationised filler by a process comprising mixing the slurry with a cellulosic suspension. Thus the slurry may be incorporated into the thick stock which is then diluted with water to form thin stock, or the slurry may be incorporated into thin stock.

However, it is also possible to achieve useful results by cationising the filler while the filler is present in a thick stock component. A thick stock component is the thick stock which is diluted to form the thin stock or is a cellulosic suspension that is used to supply part of the cellulosic content of the thick stock. A thick stock component therefore is a cellulosic suspension which is the thick stock or which is used for forming the thick stock and which has a solids content (and usually a cellulosic content) of at least about 2.5 and usually at least about 3% by weight, for instance up to 6% or 10% in some instances, or even higher. As a result of blending the filler with the cationic polymer in the thick stock the filler is more effectively cationised by the cationic polymer than if the cationic polymer is added into the thin stock containing the filler. The thick stock component which is blended with the cationic polymer while it contains filler may provide a dry weight ratio of filler:cellulosic fibre in the range 10:1 to 1:50, usually about 5:1 to 1:10.

The filler is preferably precipitated calcium carbonate. However useful results are also obtained when the filler is any other filler suitable for the production of filled paper, including china clay or other clay, chalk, kaolin or ground calcium carbonate. It may be added to the thick stock as a powder but is generally added as a slurry, typically having a filler content of at least 5%, for instance 10 to 70%.

Generally it is more convenient, and more efficient, to mix the cationic polymer with the filler in the slurry, before addition to thick stock or thin stock.

It is particularly preferred to add the cationic polymer to a slurry of precipitated calcium carbonate (PCC), which can have been made by any of the known techniques for the manufacture of PCC. Such techniques usually involve passing carbon dioxide through an aqueous solution of slaked lime, calcium oxide, to form an aqueous slurry of precipitated calcium carbonate. The slurry generally has a PCC content of at least about 5% and usually at least about 10%. Usually the PCC content is not more than about 70%, often is below 40% and usually it is below about 30%. A PCC content of around 20% (eg 15–25%) is typical. Dispersants and other conventional additives may be included in the slurry to promote stability, in conventional manner.

The crystal structure of the slurry is usually scalenohedral or rhombohedral but other precipitated calcium carbonates suitable for paper filling grades may be used. Variations in the quality of the water and the method of manufacture and other process conditions can influence the crystal structure and the performance and properties of the PCC in known manner, for instance to vary capacity, brightness or gloss.

The PCC slurry may have been treated in known manner to render it acid tolerant, for instance as described in U.S. Pat. Nos. 5,043,017 and 5,156,719. The PCC slurry which is used in paper making preferably is substantially the slurry formed initially by the precipitation process, without any intervening drying and reslurrying stage. However if desired it is possible to recover PCC from a slurry as powder and then reslurry it prior to use in paper making.

The average particle size (50% PSD) of the PCC particles in the slurry is usually within the range about 0.25 μm to 3 μm.

The invention is of particular value when applied to PCC grades which give particularly poor retention in the particular furnish which is being used. For instance the combination of pulp and the PCC is preferably such that the first pass PCC retention (as measured by a Britt Dynamic Drainage Retention Jar) would be 0–20%, often 0–15% in the absence of the cationic pretreatment but is raised by at least 15 points, often 25–60 points, by the invention to a value of at least 35% and usually 50–70% or more.

The cellulosic suspension can be formed from any suitable source of cellulosic fibres. It can be formed by dispersing dried pulp but the invention is of particular value when applied to processes where the suspension is made and used in an integrated pulp and paper mill.

Although the invention can be used on a variety of cellulosic suspensions, the suspension is preferably one that would be classified as being a relatively "dirty" suspension or as a suspension containing significant amounts of "anionic trash".

The preferred suspensions are suspensions which contain a significant amount, usually at least 30% by weight and preferably at least 50% by weight (based on the dry weight of the cellulosic feed to the suspension) selected from one or more mechanically derived pulps including thermomechanical pulp, chemimechanical pulp, and groundwood pulp, including recycled paper formed from such pulps. Other dirty pulps include pulps containing coated broke and deinked pulps and peroxide-bleached chemical and mechanical pulps. The paper-making process generally includes prolonged recycling of white water, and this also can contribute to the suspension being "dirty".

One analytical technique for indicating preferred "dirty" suspensions is by measuring conductivity, since such suspensions tend to contain ionic trash and other electrolyte. This electrolyte may originate from the initial groundwood (such as lignin compounds, extractives and hemi-celluloses) or from other sources, such as the gradual buildup of alkaline and alkaline earth metals dissolved from the suspension and recycled in white water. The dirty suspension can be such that white water (i.e., the water drained through the screen when the filled suspension containing retention aid is drained to make a sheet) has conductivity of above about 1000, and preferably above about 1,500 micro siemens, often 2,000 to 3,000 micro siemens or more. Conductivity of the white water can be determined by conventional conductivity-measuring techniques.

The anionic trash component of suitable suspensions is usually such that a relatively large amount of cationic polymer has to be added to the suspension (in the absence of PCC or other filler or retention aid additions) in order to achieve significant retention of the fibres. This is the "cationic demand". Preferably the cationic demand of the thin stock (in the absence of any of the additions defined in the invention, namely filler, cationic polymer, polymeric retention aid and inorganic anionic polymeric material) is such that it is necessary to add at least about 0.06%, and often at least about 0.1%, by weight of polyethylene imine (600 or 1000 g/t) in order to obtain a significant improvement in retention.

Another way of indicating a dirty suspension of the type preferred for use in the invention is to filter a sample of the thin stock (without any of the additions) through a fast filter paper and titrate the filtrate against a standardised solution of poly diallyl dimethyl ammonium chloride, for instance using a Mutek particle charge detector. The concentration of anionic charge in the filtrate is then usually above 0.01, and often above 0.05 or 0.1, millimoles per litre.

The pH of the suspension can be conventional. Thus it can be substantially neutral or alkaline, but if the filler has been treated to render it acid tolerant then the pH can be acidic, for instance 4 to 7, often around 6–7.

The papers that are made by the invention are those which are conventionally made from relatively dirty suspensions. The invention is of particular value to the production of newsprint and machine-finished (MF) grades but is also of value for super calendered papers, and machine-finished coated papers, and also for lightweight-coated papers and speciality groundwoods. The paper can be of any conventional weight, and so can be board, including bleached board.

The cationised PCC or other filler may be the only filler that is deliberately added, although other filler may be included, for instance as a result of incorporation of recycled paper in the suspension or as a result of deliberate addition of filler such as anhydrous or calcined clays or speciality pigments. The amount of PCC, and the total amount of filler, in the suspension that is drained is generally at least 3% or 5% (dry weight filler based on dry weight of suspension) and usually at least 10%. It can be up to 45% or even 60% in some instances but is usually below 30%. The amount of filler in the paper is generally in the range 1 to 20% or 30% (dry weight filler based on dry weight paper). The PCC is often 50 to 100% of the total filler content of the suspension and the paper.

The invention is of particular value in the production of newsprint typically containing above 1 to 10% filler, super calendered and machine-finished papers typically containing about 5 to 40% filler, and lightweight coated papers typically containing about 2 to 10% by weight filler.

The cellulosic suspension used in the invention is generally made by initially providing a thick stock and then diluting this to a thin stock, in conventional manner. The thick stock generally has a total solids content in the range about 2.5 to 10%, often around 3 to 6%, and the thin stock usually has a total solids content in the range about 0.25 to 2%, often around 0.5 to 1.5% by weight.

The slurry of PCC can be incorporated in the suspension while in the form of a thin stock, or the slurry can be incorporated while the suspension is in the form of a thick stock, and the thick stock can be diluted to a thin stock simultaneously with or after mixing the slurry of PCC into the suspension. Preferably the slurry of PCC is added into a thin stock suspension after mixing into the PCC slurry a cationising amount of a cationic polymer.

The amount of cationic polymer that is used must be sufficient to render the filler sufficiently cationic to achieve significantly improved retention in the process compared to the retention obtained if the same process is conducted in the absence of the cationic polymer. The amount which is selected is usually the amount which gives optimum retention. A suitable amount can be found by routine experimentation in that Britt Jar or other routine laboratory tests can be conducted at varying levels of addition so as to determine which is the optimum.

The amount is generally in the range about 0.005% to 2%, dry weight polymer based on the dry weight of filler being treated.

The cationic polymer can be a cationic naturally-occurring polymer, such as cationic starch. With a modified natural polymer such as this, the amount is usually at least about 0.05% such as 0.05 to 1% and is usually in the range 0.1 to 1%, often around 0.3 to 0.7%. Routine testing of a range of cationic starches will allow selection of grades (degree of substitution and origin of starch) which are suitable. Potato or other relatively low molecular weight starches are preferred. Low DS starches are preferred.

The cationic polymer is preferably selected from about 0.05 to 1% cationic starch and about 0.005 to 0.2% of a synthetic cationic polymer which has a cationic charge density of at least about 4 meq/g and intrinsic viscosity of below about 3 dl/g.

When a synthetic cationic polymer is used, it is preferred that it should have a relatively low molecular weight and a high charge density, in which event suitable amounts are generally in the range about 0.005 to 0.2%, often around about 0.01 to 0.1%.

The synthetic polymer generally has intrinsic viscosity below about 3 dl/g. Intrinsic viscosity is measured by a suspended level viscometer at 25° C. in one molar sodium chloride buffered to pH7. It can be below 1 dl/g but it is often preferable for it to be above 1 dl/g, e.g., 1.5 to 2.5 dl/g or more. Some suitable polymers have IV below 1 dl/g and some have such low molecular weight that it may not be appropriate to determine it as IV, but if IV is measurable then the value is usually at least about 0.1 or 0.2 dl/g. If the molecular weight is measured by gel permeation chromatography, the value is usually below 2 or 3 million, often below 1 million. It is usually above 100,000 and can be as low as, for instance, about 10,000 for some polymers such as dicyandiamides.

The synthetic polymer generally has a relatively high cationic charge density of at least 2 meq/g and often at least 4 meq/g, for instance 6 meq/g or more.

The cationic polymer should be used in its conventional, free polymer, form and should not be complexed or otherwise associated with a diluent which would undesirably reduce the cationic charge or increase the molecular weight of the cationic material that is added to the filler. In particular the polymer must not be complexed with a sizing component as in U.S. Pat. No. 5,147,507 since the sizing component undesirably reduces the effectiveness of the polymer for treating the filler.

The synthetic polymer can be a polyethylene imine, a dicyandiamide or a polyamine (e.g., made by condensation of epichlorhydrin with an amine) but is preferably a polymer of an ethylenically unsaturated cationic monomer, optionally copolymerised with one or more other ethylenically unsaturated monomers, generally non-ionic monomers.

Suitable cationic monomers are dialkyl diallyl quaternary monomers (especially diallyl dimethyl ammonium chloride, DADMAC) and dialkylaminoalkyl (meth)-acrylamides and (meth)-acrylates usually as acid addition or quaternary ammonium salts.

Preferred cationic polymers are polymers of diallyl dimethyl ammonium chloride or quaternised dimethylaminoethyl acrylate or methacrylate, either as homopolymers or optionally copolymerised with acrylamide. Generally the copolymer is formed of 50 to 100%, often 80 to 100%, cationic monomer with the balance being acrylamide or other water soluble non-ionic ethylenically unsaturated monomer. DADMAC homopolymers and copolymers with 0–30% by weight acrylamide, generally having IV from 1 to 3 dl/g, are preferred.

It is also possible in the invention to use, for pretrating the filler, a cationic polymer having IV above 3 dl/g. For instance copolymers of acrylamide and DADMAC (or other cationic ethylenically unsaturated monomer) having IV up to 6 or 7 dl/g are sometimes suitable.

If desired, a mixture of the cationic polymers may be used, for instance a mixture of cationic starch and a low molecular weight, high charge density, synthetic cationic polymer. Naturally the cationic polymer should be water soluble at the concentrations at which it is used.

The cationic polymer can be mixed by batch or in-line addition into the slurry as it is being pumped towards the point where it is added to the cellulosic suspension, or it can be mixed into the slurry in a storage vessel. Sufficient mixing must be applied to distribute the polymer substantially uniformly over the filler in the slurry before addition to the cellulosic suspension.

The cationic polymer can be provided as an aqueous solution which is mixed with the filler, or a powdered or reverse phase form of the cationic polymer may be used.

When the cationic polymer is being mixed into thick stock component instead of suspension, then it can be provided and mixed by analogous methods.

The thin stock usually has a total solids content in the range about 0.25 to 2%, often around 0.5 to 1.5%.

The formaldehyde resin and the polyethylene oxide are then mixed into the thin stock. They can be added simultaneously but better results are obtained if they are added sequentially. Best results are obtained when the formaldehyde resin is added first and the polyethylene oxide is added subsequently. Preferably a water soluble anionic formaldehyde resin is mixed into the filled thin stock. The formaldehyde resin is preferably a formaldehyde resin which is a soluble condensate of formaldehyde with an aromatic compound which can be, for instance, a phenol or an aromatic sulphonic acid. Thus the formaldehyde compound can be a condensate of formaldehyde with phenol alone, but it is often a condensate of formaldehyde with an aromatic sulphonic acid and optionally with a phenolic compound. The amount of formaldehyde per mole of aromatic compound is preferably 0.7 to 1.2 moles, preferably 0.8 to 0.95 or 1 moles.

Suitable sulphonic acids include napthalene sulphonic acid and xylene sulphonic acid.

The preferred formaldehyde condensate for use in the invention is phenolsulphone-formaldehyde resin (PSR resin) consisting essentially of recurring units of the formula $$—CH_2—X—$$

wherein (a) 10 to 100% of the groups X are di(hydroxyphenyl) sulphone groups, (b) 0 to 90% of the groups X are aromatic sulphonic acid groups preferably selected from hydroxy phenyl sulphonic acid groups (i.e., groups which contain at least one hydroxy-substituted phenyl ring and at least one sulphonic group) and naphthalene sulphonic acid groups and (c) 0 to 10% of the groups X are other aromatic groups, the percentages being on a molar basis.

The amount of groups (a) is usually at least 40%, and preferably at least 65% or at least 70%. It can be 100%, but is often not more than about 95%, with amounts of 75 or 80% to 95% often being preferred.

The amount of groups (b) can be zero, but it is usually desirable to include at least about 5% in order to improve the solubility of the resin. It is usually not more than 60%, although higher amounts can be used especially when the groups (b) are also groups (a). The amount of groups (b) is often in the range 5 to 35%, preferably 5 to 25%.

Groups (c) do not usually contribute usefully to the performance of the PSR and so the amount of them is usually low, often zero.

Although all the groups (b) can be naphthalene sulphonic acid groups, usually at least half, and preferably all the groups (b) are hydroxy-phenyl sulphonic acid groups.

Instead of using hydroxy phenyl sulphonic acid groups and/or naphthalene sulphonic acid groups as (b) it is possible to use any other aromatic sulphonic acid groups that are condensable into the formaldehyde condensate. Such other groups include substituted phenyl sulphonic acids such as, for instance, m-xylene sulphonic acid, but these are usually less preferred.

Any groups (c) are usually hydroxy-phenyl groups, most usually phenol or a substituted phenol.

When some or all of groups (b) are di(hydroxy-phenyl) sulphone groups which are substituted by sulphonic acid, these groups will count also as groups (a). Preferably at least half the groups (a), and usually at least three quarters and most preferably all the groups (a), are free of sulphonic acid groups.

The preferred PSR resins include 40 to 95% (usually 50 to 95% and most preferably 70 or 75% to 90 or 95%) di(hydroxy-phenyl) sulphone groups free of sulphonic acid groups and 5 to 60% (usually 5 or 10% to 25 or 30%) hydroxy phenyl sulphonic acid groups free of di(hydroxy-phenyl) sulphone groups and 0 to 10% other hydroxyl-phenyl groups.

The methylene linking groups in the PSR resins are usually ortho to a phenolic hydroxyl group and suitable PSR resins can be represented as having the following recurring groups.

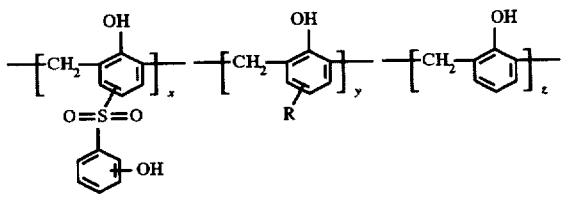

where R is $SO_3H$
and x is 0.1 to 1.0,
y is 0 to 0.9,
z is O to 0.1
and x+y+z=1 x is usually in the range 0.5 to 0.95. Preferably it is at least 0.7 and usually at least 0.75 or 0.8. Often it is not more than 0.9. y is usually 0.05 to 0.6. Often it is not more than 0.25 or 0.3. Often it is at least 0.1.

The groups may all be arranged as illustrated with each methylene linkage being ortho to a phenolic hydroxyl and with methylene linkages being meta to each other. However this is not essential and the methylene linkages may be bonded into any convenient place of each aromatic ring. In particular, it is preferred that some or all of the dihydoxy phenyl sulphone groups have the methylene linkages going on to the two phenyl rings, so that one methylene linkage is on to one phenyl ring and the other methylene linkage is onto the other ring. The various rings may be optionally substituted and usually have the sulphone group and the group R para to the phenolic hydroxyl group, as discussed below.

Preferred compounds have the formula shown above wherein x is 0.75 to 0.95, y is 0.05 to 0.25 (preferably 0.05 to 0.2), z is 0 to 0.1 (preferably 0) and R is $SO_3H$. These novel compounds are useful as retention aids in the manufacture of paper (especially in the process of the invention) and as carpet stain blockers (see for instance U.S. Pat. No. 4,680,212). The characteristic content of sulphonic groups permits the compounds to be made easily to a particularly suitable combination of high molecular weight and solubility. The molecular weight of the new compounds is preferably such that they have a solution viscosity mentioned below, preferably above 200 cps or more.

The sulphonic acid groups may be in the form of free acid or water soluble (usually alkali metal) salt or blend thereof, depending on the desired solubility and the conditions of use.

The PSR resin may be made by condensing 1 mole of the selected phenolic material or blend of materials with formaldehyde in the presence of an alkaline catalyst. The amount of formaldehyde should normally be at least 0.7 moles, generally at least 0.8 and most preferably at least 0.9 moles per mole of (a)+(b)+(c). The speed of the reaction increases, and the control of the reaction becomes more difficult, as the amount of formaldehyde increases and so generally it is desirable that the amount of formaldehyde should not be significantly above stoichiometric. For instance generally it is not more than 1.2 moles and preferably not more than 1.1 moles. Best results are generally obtained with around 0.9 to 1 mole, preferably about 0.95 moles formaldehyde.

The phenolic material that is used generally consists of (a) a di(hydroxyphenyl)sulphone, (b) a sulphonic acid selected from phenol sulphonic acids and sulphonated di(hydroxyphenyl)sulphones (and sometimes naphthalene sulphonic acid) and (c) 0 to 10% of a phenol other than a or b, wherein the weight ratio a:b is selected to give the desired ratio of groups (a):(b). Usually the ratio is in the range 25:1 to 1:10 although it is also possible to form the condensate solely from the sulphone (a), optionally with 0–10% by weight (c). Generally the ratio is in the range 20:1 to 1:1.5 and best results are generally obtained when it is in the range 20:1 to 1:1, often 10:1 to 2:1 or 3:1.

Component (a) is free of sulphonic acid groups. It is generally preferred that at least 50% by weight of component (b) is free of di(hydroxyphenyl)sulphone groups and preferably all of component (b) is provided by a phenol sulphonic acid, preferably p-phenol sulphonic acid. other phenolic material (c) can be included but is generally omitted.

The preferred PSR resins are made by condensing formaldehyde (generally in an amount of around 0.9 to 1 mole) with 1 mole of a blend formed of 95 to 40 parts by weight (preferably 95 to 80 or 75 parts by weight) di(hydroxyphenyl)sulphone that is free of sulphonic acid groups with 5 to 60 (preferably 5 to 25 or 30) parts by weight of a phenol sulphonic acid. Preferably the formaldehyde resin is a condensate of formaldehyde with 75 to 95 % di-(hydroxyphenyl) sulphone groups free of sulphonic acid groups and 5 to 25 % p-phenol sulphonic acid groups.

The di(hydroxy-phenyl)sulphone is generally a symmetrical compound in which each phenyl ring is substituted by hydroxy at a position para to the sulphone group, but other compounds of this type that can be used include those wherein either or both of the hydroxy groups is at an ortho or meta position to the sulphone group and those wherein there are non-interfering substituents elsewhere in the ring.

The hydroxyphenyl sulphonic acid generally has the hydroxyl group of the phenyl in a position para to the sulphonic acid group, but other compounds of this type that can be used include those wherein the sulphonic acid group is ortho or meta to the hydroxyl group and those wherein there are other non-interfering substituents elsewhere in the ring.

Other phenyls that can be included are unsubstituted phenyls and phenyl substituted by non-interfering groups.

Typical non-interfering groups may be included in any of the phenyl rings and include, for instance, alkyl groups such as methyl.

The molecular weight of the condensate is preferably such that a 40% aqueous solution of the full sodium salt of the sulphonic acid groups of the condensate has a solution viscosity of at least 50 cps, generally at least 200 cps and typically up to 1000 cps or more, when measured by a Brookfield viscometer using spindle 1 at 20 rpm and 20° C.

Suitable PSR resins having a content of phenol sulphonic acid are available from Allied Colloids Limited under the tradenames Alcofix SX and Alguard NS. The preferred novel compounds can be synthesised as described above.

The amount of PSR resin or other formaldehyde condensate which is added to the thin stock is generally in the range 0.2 to 5, preferably about 0.5 to 2, pounds per ton.

The polyethylene oxide preferably has a molecular weight of at least 1 or 2 million, for instance 4 to 8 million or more. It is usually added as a solution. The ratio dry weight of PSR or other formaldehyde resin:PEO is usually at least 0.5:1 and generally at least 1:1. Preferably it is at least 1.5:1. Although it may be as high as, for instance, 6:1 it is generally unnecessary for it to be above about 3:1. The amount of PEO is usually at least 50 grams/ton and usually at least 0.1 pounds/ton and is preferably in the range 0.2 to 3 pounds per ton.

Suitable formaldehyde resins and PEO and combinations thereof are disclosed in U.S. Ser. No. 08/191930 filed 4 Feb. 1994 by Brian Frederic Satterfield et al, the entire disclosure of which is hereby incorporated by reference.

The following is an example of the invention.

A cellulosic thin stock having a dry content of 1% was formed from a 0.8% cellulosic suspension based mainly on chemi thermomechanical pulp and 0.2% (based on the suspension) of an acid tolerant PCC slurry.

Tests were conducted on a Britt jar and the suspension was drained through a screen to form a wet sheet, and the first pass PCC retention was recorded.

When no cationic polymer was added to the PCC slurry and no subsequent retention system was added, the percentage retention was 1%.

When about 0.5 pounds per ton PEO was subsequently added, the retention was 9%.

When about 1 pound per ton PSR resin (formed from formaldehyde and 70 parts by weight para-para dihydroxy phenyl sulphone and 30 parts by weight para phenol sulphonic acid) followed by about 0.5 pounds per ton polyethylene oxide was added, the retention was 11%.

When the PCC slurry was treated with 0.05% by weight polydiallyl dimethyl ammonium chloride having IV 1.5 to 2, the retention when PEO alone was used was 26 but the retention when the PSR resin followed by PEO was used (in the same amounts as above) was 56.

Under the circumstances of this laboratory test, this value of 56 represents exceedingly good retention for a difficult filled suspension.

We claim:

1. A process for making filled paper comprising providing an aqueous slurry of at least 3% filler, blending this slurry with a cationizing amount of a water soluble cationic polymer thereby forming a caionized slurry wherein the cationic polymer is selected from at least about 0.05% cationic starch and at least about 0.005% of a synthetic cationic polymer which has a cationic charge density of at least about 4 meg/g and intrinsic viscosity of below about 3 dl/g, forming a filled thin stock by a process comprising mixing the cationized slurry with a cellulosic suspension and wherein alkaline earth metals dissolve from the components of the thin stock, mixing a water soluble formaldehyde resin which is a condensate of formaldehyde with phenolic compound and/or aromatic sulphonic acid and polyethylene oxide of molecular weight at least 1 million into the filled thin stock wherein the dry weight ratio formaldehyde resin:polyethylene oxide is at least 0.5:1 and the amount of polyethylene oxide is at least 50 g/t, and then draining the filled thin stock through a screen to form a sheet and drying the sheet.

2. A process according to claim 1 in which the cellulosic suspension is a suspension formed from at least about 30% of a cellulosic pulp selected from mechanically derived pulp, coated broke pulp, de-inked pulp and peroxy-bleached chemical or mechanical pulp.

3. A process according to claim 1 in which the thin stock gives a white water having conductivity at least about 1500 micro siemens.

4. A process according to claim 1 in which the paper is selected from newsprint, supercalendered grades, machine finished grades, machine finished coated grades, lightweight coated grades, and speciality groundwoods.

5. A process according to claim 1 in which the water soluble formaldehyde resin is added to the filled thin stock and the polyethylene oxide is subsequently added to the filled thin stock.

6. A process according to claim 1 in which the filler comprises ground calcium carbonate or precipitated calcium carbonate.

7. A process for making filled paper comprising mixing a slurry of precipitated calcium carbonate with a cationizing amount of a cationic polymer wherein the cationic polymer is selected from at least about 0.05% cationic starch and at least about 0.005% of a synthetic cationic polymer which has a cationic charge density of at least about 4 meg/g and intrinsic viscosity of below about 3 dl/g, forming a thin stock by a process comprising mixing the cationized slurry of PCC with a cellulosic suspension, then mixing a water soluble formaldehyde resin which is a condensate of formaldehyde with phenolic compound and/or aromatic sulphonic acid into the filled thin stock, and then mixing polyethylene oxide of molecular weight at least 1 million into the thin stock wherein the dry weight ratio formaldehyde resin:polyethylene oxide is at least 0.5:1 and the amount of polyethylene oxide is at least 50 g/t, and then draining the thin stock through a screen to form a sheet and drying the sheet.

8. A process according to claim 7 in which the cellulosic suspension is a suspension formed from at least about 30% of a cellulosic pulp selected from mechanically derived pulp, coated broke pulp and de-inked pulp and peroxy-bleached chemical or mechanical pulps.

9. A process according to claim 7 in which the thin stock suspension gives a white water having conductivity at least about 1500 micro siemens.

10. A process according to claim 7 in which the paper is selected from newsprint, supercalendered grades, machine finished grades, machine finished coated grades, lightweight coated grades, and speciality groundwoods.

11. A process according to claim 7 in which the cationic polymer is selected from cationic starch, polyethylene imines, dicyandiamides, polyamines and polymers of dialkylaminoalkyl (meth)-acrylate or -acrylamide and polymers of diallyl quaternary monomers.

12. A process according to claim 7 in which the cationic polymer is a polymer of diallyldimethyl ammonium chloride optionally copolymerised with acrylamide.

13. A process according to claim 7 in which the formaldehyde resin is a condensate of formaldehyde with an aromatic sulphonic acid and a phenolic compound.

14. A process according to claim 7 in which the formaldehyde resin is a condensate of formaldehyde with aromatic sulphonic acid groups and di-(hydroxyphenyl) sulphone groups.

15. A process according to claim 7 in which the formaldehyde resin is a condensate of formaldehyde with 75 to 95% di-(hydroxyphenyl) sulphone groups free of sulphonic acid groups and 5 to 25% p-phenol sulphonic acid groups.

16. A process according to claim 15 in which the amount of polyethylene oxide is at least 50 g/t and the dry weight of formaldehyde resin:polyethylene oxide is at least 1:1.

17. A process for making filled paper comprising providing an aqueous slurry of at least 10% precipitated calcium carbonate, blending this slurry with a cationizing amount of a cationic polymer selected from about 0.05 to 1% cationic starch and 0.005 to 0.2% of a synthetic cationic polymer which has a cationic charge density of at least about 4 meq/g and intrinsic viscosity of below about 3 dl/g, thereby forming a cationized slurry, forming a filled thin stock by a process comprising mixing the cationized slurry with a cellulosic suspension formed from at least about 30% of a cellulosic pulp selected from the group consisting of mechanically derived pulp, coated broke pulp, deinked pulp and peroxy bleached chemical or mechanical pulp and thereby forming a thin stock, mixing a water soluble formaldehyde resin which is a condensate of formaldehyde with phenolic compound and/or aromatic sulphonic acid and polyethylene oxide of molecular weight at least 1 million into the thin stock wherein the dry weight ratio formaldehyde resin:polyethylene oxide is at least 0.5:1 and the amount of polyethylene oxide is at least 50 g/t, and then draining the thin stock through a screen to form a sheet and drying the sheet.

18. A process according to claim 17 in which the cationic polymer is selected from cationic starch, polyethylene imines, dicyandiamides, polyamines and polymers of dialkylaminoalkyl (meth)-acrylate or -acrylamide and polymers of diallyl quaternary monomers.

19. A process according to claim 17 in which the cationic polymer is a polymer of diallyl dimethyl ammonium chloride optionally copolymerised with acrylamide.

20. A process according to claim 17 in which the formaldehyde resin is a condensate of formaldehyde with an aromatic sulphonic acid and a phenolic compound.

21. A process according to claim 17 in which the formaldehyde resin is a condensate of formaldehyde with aromatic sulphonic acid groups and di-(hydroxyphenyl) sulphone groups.

22. A process according to claim 17 in which the formaldehyde resin is a condensate of formaldehyde with 75 to 95 % di-(hydroxyphenyl) sulphone groups free of sulphonic acid groups and 5 to 25 % p-phenol sulphonic acid groups.

23. A process according to claim 22 in which the amount of polyethylene oxide is at least 50 g/t and the dry weight of formaldehyde resin:polyethylene oxide is at least 1:1.

24. A process according to claim 17, in which the water soluble formaldehyde resin is added to the filled thin stock and the polyethylene oxide is subsequently added to the filled thin stock.

* * * * *